US006629798B1

(12) United States Patent
Fukami et al.

(10) Patent No.: US 6,629,798 B1
(45) Date of Patent: Oct. 7, 2003

(54) PEN

(76) Inventors: Masaaki Fukami, 2-43-2 Miyoshi-cho, Fuchu-shi, Tokyo (JP); Toshio Manabe, 1300-35 Oazanaka, Tsuchiura-shi, Ibaragi (JP)

( * ) Notice: Subject to any disclaimer, the term of this patent is extended or adjusted under 35 U.S.C. 154(b) by 0 days.

(21) Appl. No.: 09/362,921

(22) Filed: Jul. 27, 1999

(30) Foreign Application Priority Data

Jul. 28, 1998 (JP) ..... 100082740

(51) Int. Cl.[7] ..... B43K 8/08
(52) U.S. Cl. ..... 401/199
(58) Field of Search ..... 401/199, 198, 401/196, 205

(56) References Cited

U.S. PATENT DOCUMENTS 4,764,044 A * 8/1988 Konose ..... 401/150
4,792,252 A * 12/1988 Kremer et al. ..... 401/206
4,913,175 A * 4/1990 Yokosuka et al. ..... 132/317
5,290,116 A * 3/1994 Chang ..... 401/199
5,362,168 A * 11/1994 Abe et al. ..... 401/206
5,829,904 A * 11/1998 Matsumoto et al. ..... 401/209
5,967,687 A * 10/1999 Oike ..... 401/198
6,416,242 B1 * 7/2002 Kaufmann ..... 401/198

* cited by examiner

*Primary Examiner*—Gregory L. Huson
*Assistant Examiner*—Huyen Le
(74) *Attorney, Agent, or Firm*—George W. Finch

(57) ABSTRACT

There is provided a pen in which ink is supplied steadily from an ink tank to a pen point.

Ink in an ink tank 6 is supplied to a pen point 5 through a slender tube portion 4A of an ink introducing slender tube 4. Excess ink can be kept by a stuffing member 7 that is in contact with a portion in which the ink introducing slender tube 4 and the pen point 5 are connected to each other and a gap 8 provided in the connecting portion.

20 Claims, 6 Drawing Sheets

PEN

BACKGROUND OF THE INVENTION

As a conventional pen, a pen has been used, like a fountain pen, which has such a configuration that a writer holds the rear end portion of a pen body in a state in which a spare ink tank is mounted into the pen body from the rear end side, and writes letters and the like on a writing paper with a pen point at the tip end of the pen body. A large number of such pens have been used because of their convenience of being capable of being used as a writing instrument for a long period of time merely by replacing the spare ink tank, one after another.

In the writing instrument using liquid ink in this manner, however, when the temperature of air in the spare ink tank increases in a state in which the amount of ink in the spare ink tank decreases as the writer uses the writing instrument, the air in the spare ink tank expands, thereby increasing the air pressure. Thereupon, there is a possibility that excess ink is pushed out of the spare ink tank to the pen body and falls in drops from the pen point.

When the spare ink tank is housed in a portion gripped by writer, of the pen body, writers body temperature is conducted to the spare ink tank through the pen body, so that the air in the spare ink tank is easily warmed. In such a case, the ink in the spare ink tank is inevitably pushed out excessively by the air expanded by the body temperature.

SUMMARY OF THE INVENTION

The present invention has been made in view of the above situation, and accordingly an object thereof is to provide a pen which can always supply a proper amount of ink to a pen point even when the temperature in an ink tank is changed. The present invention accomplishes such by using a capillary tube to feed ink from its storage tank to a fiber pen tip. To avoid either soaking the pen tip or having it go dry when conditions overwhelm the capillary flow causing it to flow an undesired amount of ink, a fluid gap is formed between the capillary tube and the tip with a porous stuffing member positioned thereabout to form a temporary storage device that can take up ink excess flow and then provide it to the tip when it is needed. A compressing structure about the stuffing member can be provided to increase its density and lower its porosity about the gap to increase the capillary force in that area.

DETAILED DESCRIPTION OF THE INVENTION

To solve the above problems, the present invention provides a pen comprising an ink tank 6 for supplying ink, an ink introducing slender tube 4, the rear end portion of which is connected to the ink tank 6, for introducing the ink in the ink tank 6 through a slender tube portion 4A formed inside; a pen point 5, having pores, for drawing out the ink flowing out of the ink introducing slender tube 4 to the tip end face thereof by connecting the rear end portion thereof to the tip end portion of the ink introducing slender tube 4; and a stuffing member 7, which is provided so as to be in contact with the rear end portion of the pen point 5, for holding excess ink when excess ink flows out of the ink introducing slender tube 4 and for supplying the ink held therein to the pen point 5 when the ink flowing to the pen point 5 runs short.

Embodiments of the present invention will be described in detail with reference to the accompanying drawings.

(1) First Embodiment

Figure 1:
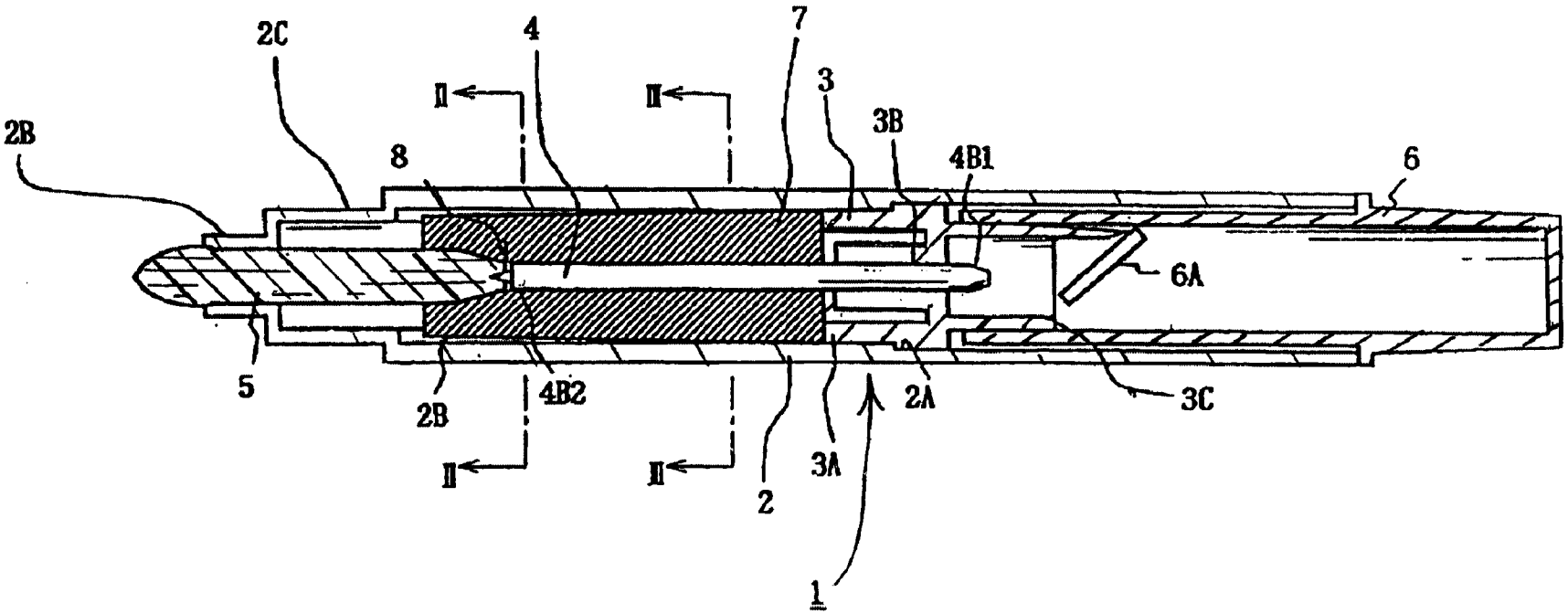
FIG. 1 is a cross-sectional view showing a general configuration of a pen in accordance with a first embodiment of the present invention.

In FIG. 1, reference numeral 1 denotes a writing pen as a whole, which has a cylindrical pen body 2 molded from a synthetic resin material. A columnar inner holding member 3 is fitted in the pen body 2. The inner holding member 3 is inserted into the pen body 2 through the rear end opening of the pen body 2, and is held by being fitted in a state in which a fitting portion 3 the tip end side abuts on a locking step portion 2A formed inside the pen body 2. A holding hole 3B is formed on the centerline of the inner holding member 3 so as to penetrate the thickness of the inner holding member 3, and an ink introducing slender tube 4 is fitted so as to be put through the holding hole 38.

The ink introducing slender tube, which is disposed on the centerline of the pen body 2, has a rear end portion 4B1 projecting rearward toward an ink tank 6 from the inner holding member 3 and a tip end portion 4B2 extending toward the tip end to a position at which it connects to the rear end portion of a pen point 5.

The pen point 5 is made of a porous felt material, which is formed by bundling fiber layers together and by stiffening it with a resin into a circular shape in cross section, and held by being fitted in a cylindrical pen point holding portion 2B formed so as to project toward the tip end at the central position of the tip end portion of the pen body 2.

Figure 2:
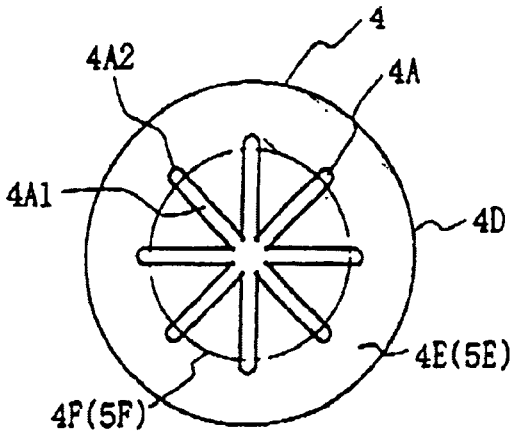
FIG. 2 is a cross-sectional view taken along the line II—II of FIG. 1.

As shown in FIG. 2, the ink introducing slender tube 4 has a construction formed columnarly of a synthetic resin material. A plurality of, for example, eight ink introducing slits 4A, having a cross-sectional shape extending outward radially on the centerline, are formed so as to communicate with each other at the center, by which a slender tube portion passing through the interior of the ink introducing slender tube 4 is formed.

The slit width of the slender tube portion of the ink introducing slit 4A is set so that the ink supplied from the ink tank 6 through the slender tube portion is not caused to flow down (though drips little by little) from the lower end face of the ink introducing slender tube 4 by a capillary force produced by the capillarity of the slender tube portion when small vibrations such as vertical movement is applied to the whole writing pen 1 in a state in which the writing pen 1 is put vertically with the pen point 5 pointing downward. As a result, the ink introducing slits 4A of the ink introducing slender tube 4 is always filled with the ink in the ink tank 6.

At the rear end portion of the inner holding member 3, a cylindrical ink tank holding protrusion 3C is provided so as to extend rearward, so that when the ink tank 6 is inserted through the rear end opening of the pen body 2, the ink tank holding protrusion 3C pushes a plug 6A of the ink tank 6 into the ink tank 6, by which the ink tank 6 is unplugged. Also, the ink tank holding protrusion 3C holds the unplugged ink tank 6 by fitting the tip end portion of the ink tank 6 to the outside of the ink tank holding protrusion 3C.

The rear end portion 4B1 of the ink introducing slender tube 4 projects into the ink tank holding protrusion 3C. Thereby, the ink in the unplugged ink tank 6 held by the ink tank holding protrusion 3C is introduced into the ink introducing slits 4A of the ink introducing slender tube 4, and is caused to flow out to the pen point 5 connected to the tip end of the ink introducing slender tube 4. Thus, the ink flowing out to the rear end portion of the pen point 5 is drawn out to the tip end face of the pen point 5 by a capillary force produced by the capillarity between the fibers of the pen point 5. Thereupon, when the tip end face of the pen point 5 touches the writing paper, the ink drawn out to the tip end face of the pen point 5 is put onto the writing paper.

Figure 3:
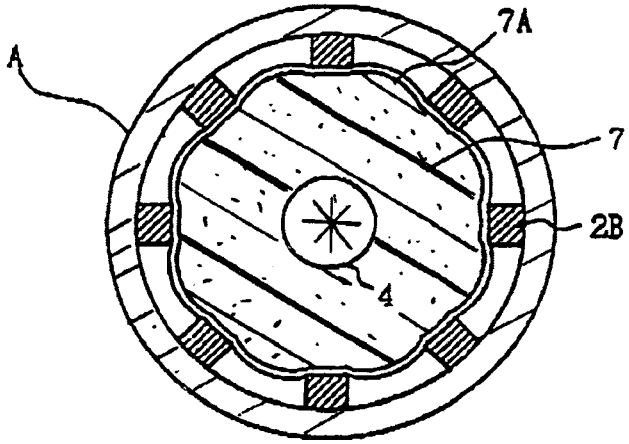
FIG. 3 is a cross-sectional view taken along the line III—III of FIG. 1.

On the inner peripheral surface of the pen body 2, a plurality of, for example, eight ribs 2B are formed, as shown in FIG. 3, over the range from a portion in which the pen point 5 and the ink introducing slender tube 4 are connected to each other to a position at which the inner holding member 3 is fitted. A portion in which the ribs 2B are formed is packed with a stuffing member 7. The stuffing member 7, as shown in FIG. 3, has a construction such that a cylindrical tube 7A formed by extrusion molding cylindrical cellophane or polypropylene is packed with polyester fibers, polypropylene fibers, or acrylic fibers of 2.0 to 10.0 deniers.

The rib 2B has an inclined surface such that the rib height increases gradually from the position of the inner holding member 3 toward the tip end. Thereupon, the portion of the stuffing member 7 in which the pen point 5 and the ink introducing slender tube 4 are connected to each other is subjected to a stronger compressive force than other portions, the porosity between fiber layers of the stuffing member 7 is decreased by compression gradually toward the tip end. Thereby, the capillary force produced by the capillarity between the fiber layers is larger at a portion in contact with the portion in which the pen point 5 and the ink introducing slender tube 4 are connected to each other than at a portion on the side of the inner holding member 3. Thus, when the stuffing member 7 is loaded with ink, a force such as to cause ink to flow to the tip end portion in which the capillary force is large acts, whereby the ink contained in the stuffing member 7 is collected and accumulated in the portion in which the pen point 5 and the ink introducing slender tube 4 are in contact with each other.

Figure 4:
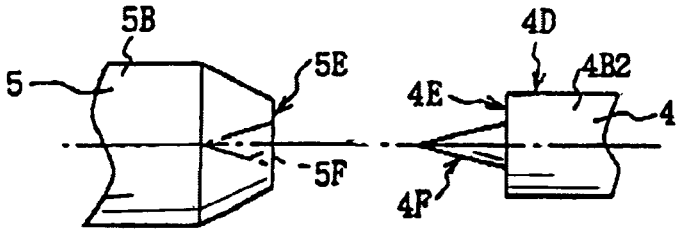
FIG. 4 is an exploded aide view showing a detailed configuration of a portion in which an ink introducing slender tube and a pen point, shown in FIG. 1, are connected to each other.

In this embodiment, the tip end portion 4B2 of the ink introducing slender tube 4 is, as shown in FIG. 4, formed with a flat face 48 directed to the center so as to cut the ink introducing slender tube 4 in the direction perpendicular thereto from an outer peripheral surface 4D and a projecting face 4F consisting of a conical face projecting from a position on the inside of the flat face 4E toward the tip end.

On the other hand, the rear end portion 5B of the pen point 5 is formed with a flat face 5E consisting of a cut face such as to be opposed to the flat face 4E of the ink introducing slender tube 4 and a concave face 5F corresponding to the projecting face 4F of the ink introducing slender tube 4. Thereupon, when the projecting face 4F of the ink introducing slender tube 4 abuts on the concave face 5F of the pen point 5, the pen point 5 and the ink introducing slender tube 4 are connected to each other with a small gap 8 (not larger than 0.5 mm, preferably not larger than 0.1 mm) between the flat face 4E formed around the projecting face 4F and the flat face BE of the pen point 5.

In this connecting condition, while inner peripheral slit portions 4A1 in which the projecting face 4F is formed, of the ink introducing slits 4A of the ink introducing slender tube 4, are brought into direct contact with the concave face 5F, outer peripheral slit portions 4A2 of the ink introducing slit 4A are exposed to the gap 8 between the flat faces 4E and BE, so that the outer peripheral slit portions 4A2 communicate with a space of the gap 8.

Thus, the slit portions 4A1 exposed to the projecting face 4F, of the ink introducing slits 4A of the ink introducing slender tube 4, communicate with the pen point 5 by touching the concave face 5F, and the slit portions 4A2 exposed to the flat face 4E communicate with the stuffing member 7 through the gap 8.

Actually, as a working method for bringing the projecting face 4F of the ink introducing slender tube 4 into contact with the concave face 5F of the pen point 5 so that the gap 8 is kept, a method is used in which the projecting face 4F of the ink introducing slender tube 4 is stuck in the rear end face of the pen point 5 on which the concave face 5F has not yet been formed. Also, in this embodiment, the tip end portion of the pen body 2 is formed with a step portion for forming a cap holding portion 2C, by which a cap (not shown) can be put so as to cover the pen point 5.

In the above-described configuration, when an unused, fully-filled ink tank 6 is mounted on the ink tank holding protrusion 3C of the inner holding member 3, the ink in the ink tank 6 flows out so as to fill the ink introducing slits 4A forming the slender tube portion of the ink introducing slender tube 4.

At this time, the ink tank 6 has a negative pressure such as to correspond to the amount of ink having flowed out. However, until the portion in which the ink introducing slender tube 4 and the pen point 5 are connected to each other comes to be soaked with ink, the air in pores in the stuffing member 7 in sucked through the pen point 5 or the gap 8 into the ink introducing slits 4A forming the slender tube portion of the ink introducing slender tube 4 as fine air, and travels to the ink tank 6. Thereby, the change of air corresponding to the flowing-out ink is produced, so that action such as to eliminate the negative pressure in the ink tank 6 is brought about.

When ink flows out to the tip end portion of the ink introducing slender tube 4, the ink soaks the concave face 5F of the pen point 5 through the projecting face 4F of the ink introducing slender tube 4. In this condition, the ink is sucked by the capillary force produced by the capillarity between the fiber layers of the pen point 5 into the tip end portion of the pen point 5, and put onto the writing paper. Thus, when the ink in the ink tank 6 comes to soak the tip end face of the pen point 5, fine air of an amount corresponding to the consumed ink is sucked into pores in the pen point 5 at the tip end face of the pen point 5. Then, it is sent into the ink tank 6 through the ink introducing slits 4A of the ink introducing slender tube 4, so that the negative pressure in the ink tank 5 is eliminated by the change from ink to air. In this condition, when the air in the ink tank 6 is expanded by the increase in temperature in the ink tank 6 caused, for example, by writer's body temperature, the air pressure in the ink tank 6 is increased, so that excessive ink is supplied to the rear end portion of the pen point 5 through the ink introducing slits 4A of the ink introducing slender tube 4. At this time, not all of the excess ink can be sucked in the tip end direction of the pen point 5 by the capillary force in the pen point 5. The excess ink is discharged into the stuffing member 7 through the gap 8 by passing through the slit portions 4A2 of the ink introducing slits 4A projecting to the flat face 4E opposed to the gap 8, or is discharged into the stuffing member 7 from the rear end portion of the pen point 5, by which the excessive air is kept in the stuffing member 7.

In this condition, when ink runs short in the tip end portion of the pen point 5 as the ink is put onto the writing paper from the pen point 5, the ink supplied from the ink introducing slender tube 4 or the ink discharged into the stuffing member 7 is sucked from the rear end portion of the pen point 5 and supplied to the tip end face thereof by a relatively large capillary force of the pen point 5.

In this embodiment, when the pen 1 is put upright so that the tip end portion is pointed downward, the ink introducing slender tube 4 has a capillary force of such a degree that the ink drips through the ink introducing slits 4A. Thereby, ink can be supplied to the pen point 5 in the same state as that in which the pen point 5 is directly connected to the ink tank 6. Also, the porosity of the pen point 5 is set at about 45 to 50%, and the porosity of the stuffing member 7 is set at about 90 to 92%. Thereupon, the capillary force of the pen point 5 is larger than that of the stuffing member 7. As a result, the stuffing member 7 sucks excessive ink that cannot be sucked by the pen point 5, and when the pen point 5 becomes short of ink, the ink in the stuffing member 7 can be sucked.

Thus, in the state in which ink is discharged into the stuffing member 7, the capillary force of the stuffing member 7 increases at a point closer to the tip end because the stuffing member 7 is compressed with a higher degree of compression at a point closer to the tip end by the inclined surfaces of the ribs 2A of the pen body 2. Therefore, the ink discharged into the stuffing member 7 is always kept in a state of accumulating around the portion in which the pen point 5 and the ink introducing slender tube 4 are connected to each other. Thereby, ink can be securely supplied from the stuffing member 7 to the pen point 5. In this manner, the ink pushed out by the increase in temperature in the ink tank 6 is not supplied excessively to the tip end of the pen point 5, and the overflowing ink portion is kept in the stuffing member 7 through the gap 8, which prevents the occurrence of a state in which excess ink falls in drops from the tip end of the pen point.

Thus, when temperature of the ink tank 6 decreases in the state in which ink accumulates in the stuffing member 7, the air in the ink tank 6 contracts, by which the air pressure in the ink tank 6 is decreased.

At this time, the ink in the ink introducing slits 4A of the ink introducing slender tube 4 is strongly sucked into the ink tank 6, by which the ink accumulating in the gap 8 and the stuffing member 7 flows into the ink introducing slits 4A of the ink introducing slender tube 4 through the slit portions 4A2 exposed on the flat face 4E of the ink introducing slender tube 4, and is sent to the ink tank 6. In this condition, when the gap 8 and the stuffing member 7 become short of ink, the air in the pores of the stuffing member 7 flows into the ink tank 6. Thus, the decrease in air pressure in the ink tank 6 is eliminated. During this time, the ink in the stuffing member 7 or the pen point 5 is supplied to the tip end face of the pen point 5 by the capillary force thereof.

According to the above-described configuration, the ink introducing slender tube 4 with a capillary force is provided between the ink tank 6 and the pen point 5, so that a pen capable of smoothly changing from ink to air effected when ink is consumed from the tip end face of the pen point 5 can be realized.

The ink introducing slender tube 4 has a capillary force of such a degree that ink can be kept in the inner slender tube portion even when the writing pen 1 is put upright. This means that the ink in the ink tank 6 located in the rear end portion of the pen body 2 can be supplied by a necessary amount to the pen point 5 located in the tip end portion of the pen body 2 under the same condition as that at the outlet position of the ink tank 6. Even if a porous material (therefore having a large capillary force) with a relatively small capillary force is used as the pen point 5, therefore, the length of the pen point 5 can be decreased (even in this case, ink does not fall in drops). Thereupon, a proper amount of ink can be caused to flow from the ink introducing slender tube 4 to the tip end of the pen point 5. Moreover, since the pen point 5 has large pores, the change of air can be achieved in proper amounts (without the inflow of excess air) when ink is consumed from the face of the pen point 5.

Also, by keeping the stuffing member 7 in contact with the portion in which the ink introducing slender tube 4 and the pen point 5 are connected to each other (in particular, in a compressed state such that the capillary force of the tip end portion is larger), when excess ink is supplied from the ink introducing slender tube 4 to the pen point 5, the excess ink is discharged to the stuffing member 7 through the gap 8 and accumulated therein. This prevents the excess ink from falling in drops from the tip end face of the pen point 5.

In this condition, when ink is consumed from the tip end of the pen point 5 and ink must be supplied to the pen point 5, ink can be supplied from the ink introducing slender tube 4 or the stuffing member 7 to the pen point 5. Contrarily, if the air pressure in the ink tank 6 decreases, ink or air is drawn from the surrounding stuffing member 7 into the ink tank 6 through the gap 8 by being caused to pass through the ink introducing slits 4A of the ink introducing slender tube 4. Thereby, the negative pressure or decreased air in the ink tank 6 can be eliminated.

Thus, even if the condition around the writing pen 1 is changed, a proper amount of ink can always be supplied to the tip end of the pen point 5.

An experiment, in which the ink tank 6 containing oil based ink is mounted and the temperature is changed in the range from 50 to 15ûC, has proven that there is no trouble such that excess ink falls in drops from the pen point 5 or that the supply of ink from the ink tank 6 to the pen point 5 is ceased.

It has also been proven that the necessary inclination angle of the rib 2B to accumulate ink in the tip end portion of the stuffing member 7 is 2 to 5 degrees.

Also, according to the experiment, a satisfactory operation result was obtained when the gap 8 was not larger than 0.5 mm, preferably not larger than 0.1 mm.

(2) Second Embodiment

Figure 5:
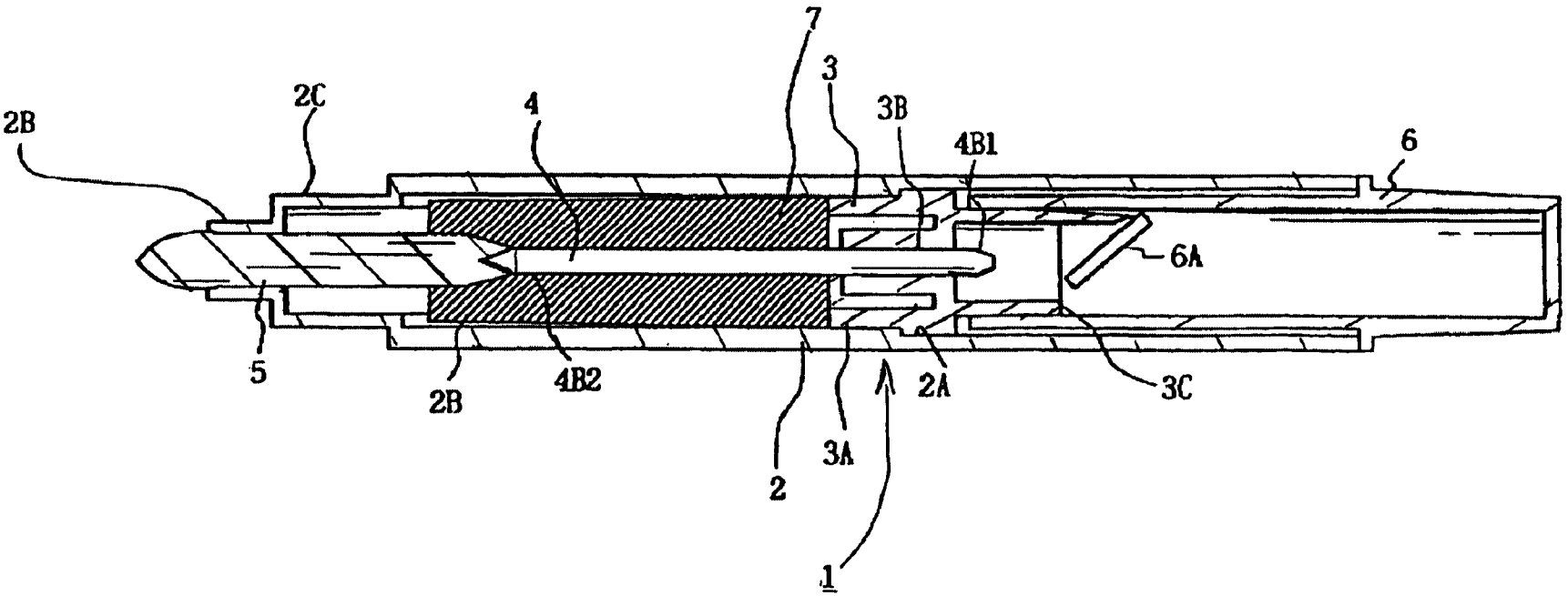
FIG. 5 is a cross-sectional view showing a general configuration of a pen in accordance with a second embodiment.

FIG. 5 shows a second embodiment. In this figure, the same reference numerals are applied to the elements corresponding to FIG. 1, and the writing pen 1 is configured so that the ink introducing slender tube 4 and the pen point 5 are connected directly to each other without providing the gap 8.

In the configuration shown in FIG. 5, when the ink tank 6 is mounted on the ink tank holding protrusion 3C of the inner holding member 3, whereby the ink in the ink tank 6 flows to the tip end portion 4B2 through the ink introducing slits 4A of the ink introducing slender tube 4, the ink having flowed from the tip end portion 4B2 is drawn out to the tip end portion of the pen point 5 by the capillary force of the pen point 5. Thereby, the ink supplied to the tip end face of the pen point 5 is put onto the writing paper.

Thus, when the ink supplied from the ink tank 6 is consumed on the tip end face of the pen point 5, a negative pressure corresponding to the consumed amount is produced on the side of the ink tank 6, so that fine air is drawn in from the tip end of the pen point 5, and further drawn from the pen point 5 into the ink tank 6 through the ink introducing slits 4A of the ink introducing slender tube 4. Thereupon, the change action of air eliminates the negative pressure in the ink tank 6.

In this condition, when the increase in temperature in the ink tank 6 increases the air pressure in the ink tank 6, the ink pushed out to the ink introducing slits 4A of the ink introducing slender tube 4 by the air pressure flows out into the pen point 5. When the amount of flowing-out ink becomes excessive exceeding the amount that can be treated by the capillary force of the pen point 5, the excess ink flows out from the rear end portion of the pen point 5 into the stuffing member 7 that is in contact with the rear end portion. At this time, in the stuffing member 7, a large capillary force acts toward the tip end portion because the tip end portion is compressed more strongly by the inclined surfaces of the ribs 2B. Thereupon, the ink having flowed out into the stuffing member 7 accumulates in the tip end portion without flowing toward the rear end.

In this condition, when ink is consumed from the tip end face of the pen point 5, the ink accumulating in the tip end portion of the stuffing member 7 is drawn into the pen point 5 by the capillary force in, the rear end portion of the pen point 5. Thus, in this case as well, ink can be supplied steadily to the pen point 5.

Inversely, when the decrease in temperature in the ink tank 6 contracts the air in the ink tank 6, thereby decreasing the air pressure, the decrease in air pressure is transmitted to the tip end portion 4B2 through the ink introducing slits 4A of the ink introducing slender tube 4. Thereby, the ink in the stuffing member 7, which is in contact with the rear end portion of the pen point 5 and the surroundings thereof is drawn hack toward the ink tank 6 through the ink introducing slender tube 4. At this time, if ink is not accumulated in the tip end portion of the stuffing member 7, fine air is drawn from the pores in the tip end portion of the stuffing member 7 or the rear end portion of the pen point 5 into the ink tank 6 through the ink introducing slender tube 4. Thereupon, the decrease in air pressure in the ink tank 6 is eliminated.

Thus, according to the configuration shown in FIG. 5, even if the temperature in the ink tank 6 increases or decreases, excess ink is not supplied to the pen point 5, or the ink to be supplied to the pen point 5 does not run short, so that ink can always be supplied steadily to the pen point 5.

(3) Third Embodiment

Figure 6:
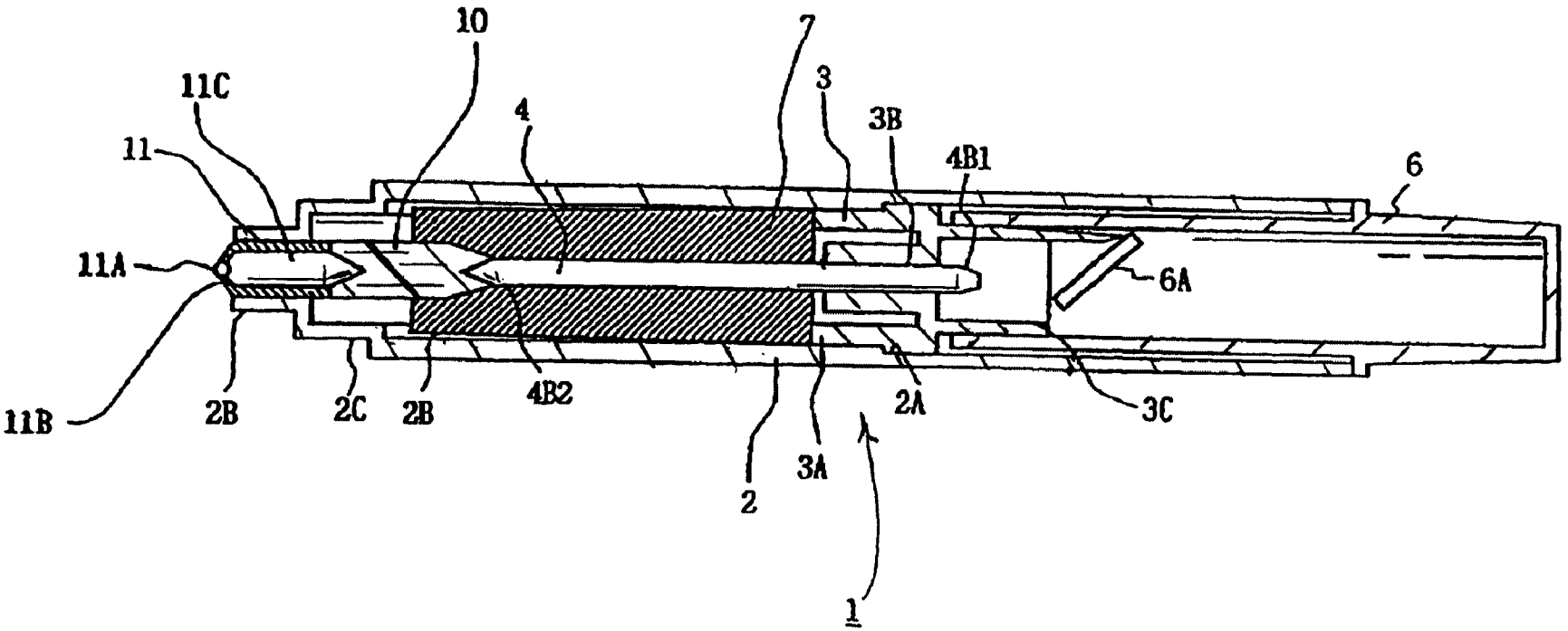
FIG. 6 is a cross-sectional view showing a general configuration of a pen in accordance with a third embodiment.

FIG. 6 shows a third embodiment. In this figure, the same reference numerals are applied to the elements corresponding to FIG. 5. In this embodiment, a connecting ink introducing member 10 made of a porous material is connected to the tip end of the ink introducing slender tube 4, and a ball pen point 11 is connected to the tip end portion of the connecting ink introducing member 10. The connecting ink introducing member 10 is made by stiffening fibers with a resin into a porous material or by sintering resin powder.

The ball pen point 11 holds a ball holding cylinder 11B for rotatably holding a writing ball 11A by means of a pen point holding portion 2B. A pen point ink introducing member 11C made of a porous material is provided in the ball holding cylinder 11B so that the rear end portion thereof is connected to the connecting ink introducing member 10 and the tip end portion thereof is in contact with the writing ball 11A. In this case, the porosity of the pen point ink introducing member 11C is set at a smaller value than the porosity of the connecting ink introducing member 10, so that the capillary force of the pen point ink introducing member 11C is larger than that of the connecting ink introducing member 10.

In the configuration shown in FIG. 6, the ink supplied from the ink tank 6 through the ink introducing slender tube 4 is drawn out from the tip end portion 4B2 of the ink introducing slender tube 4 by the capillary force of the connecting ink introducing member 10, and flows toward the pen point ink introducing member 11C connected to the tip end portion of the connecting ink introducing member 10.

Since the capillary force of the pen point ink introducing member 11C in set at a larger value than the capillary force of the connecting ink introducing member 10, the ink in the connecting ink introducing member 10 is drawn out to the pen point ink introducing member 11C and flows toward the writing ball 11A that is in contact with the tip end portion of the pen point ink introducing member 11C.

Thus, when the writing ball 11A puts the ink in the pen point ink introducing member 11C onto the writing paper, a corresponding amount of fine air is sent to the ink tank 6 through the pen point ink introducing member 11C, the connecting ink introducing member 10, and the ink introducing slender tube 4 by the change action of air. Thereupon, ink can be put onto the writing paper by the ball pen point 11.

In the third embodiment, when the increase in temperature in the ink tank 6 increases the air pressure in the ink tank 6, whereby excess ink is supplied through the ink introducing slender tube 4, the excess ink flows out into the stuffing member 7 that is in contact with the connecting ink introducing member 10 and is kept in the stuffing member 7. Thereafter, whenever ink is consumed by the writing ball 11A, the ink accumulating in the stuffing member 7 is supplied to the writing ball 11A through the connecting ink introducing member 10 and the pen point ink introducing member 11C.

Contrarily, when the air pressure in the ink tank 6 is decreased by the decrease in temperature in the ink tank 6, the ink accumulating in the stuffing member 7 is sent back to the ink tank 6 through the connecting ink introducing member 10 and the ink introducing slender tube 4.

According to the configuration shown in FIG. 6, even when the ball pen point 11 is used as a pen point, ink can always be supplied from the ink tank 6 to the writing ball 11A.

(4) Fourth Embodiment

Figure 7:
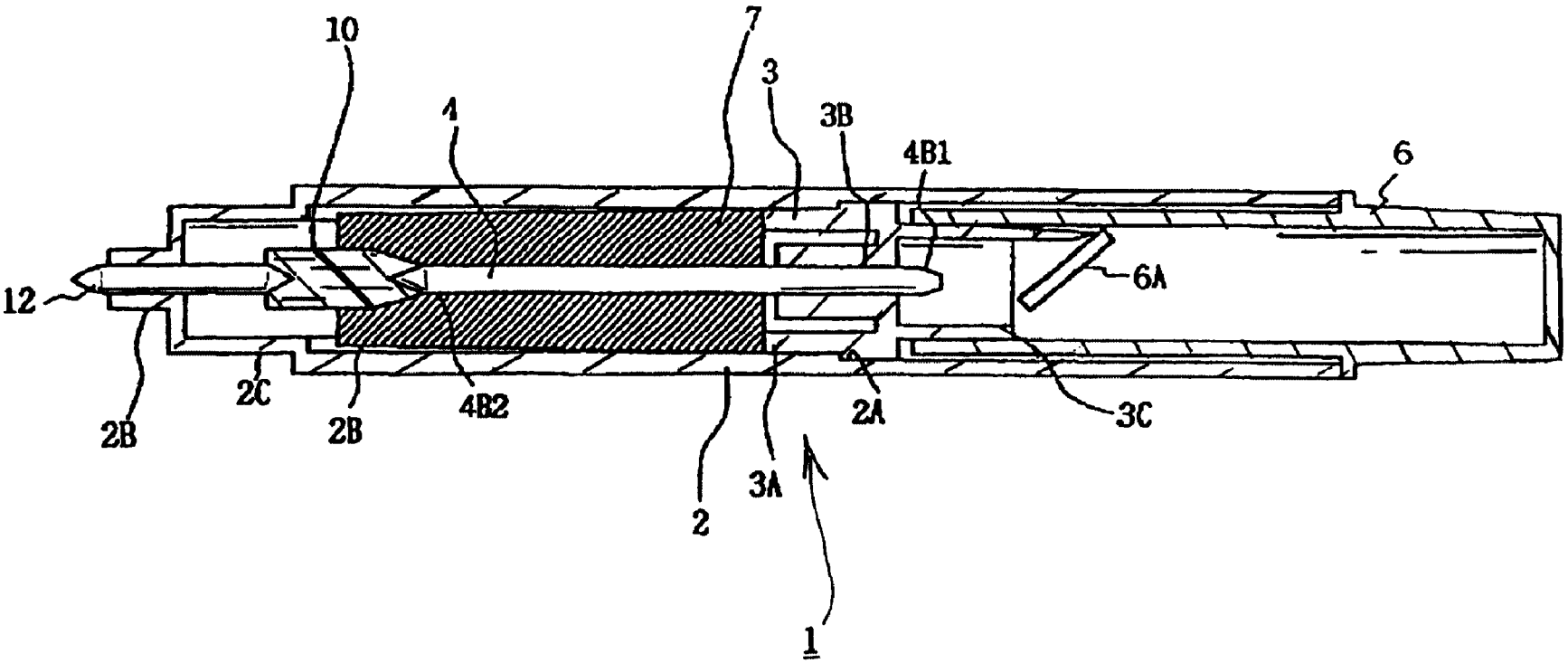
FIG. 7 is a cross-sectional view showing a general configuration of a pen in accordance with a fourth embodiment.

FIG. 7 shows a fourth embodiment. In this figure, the same reference numerals are applied to the elements corresponding to FIG. 6. In this embodiment, a plastic pen point 12 is provided as a pen point so that the rear end portion thereof is connected to the connecting ink introducing member 10. The plastic pen point 12 is made of a porous material, which is formed by stiffening fibers with a resin into a porous material or by sintering resin powder.

In this case, the porosity of the plastic pen point 12 has smaller value than the porosity of the connecting ink introducing member 10, so that the capillary force of the plastic pen point 12 is larger than that of the connecting ink introducing member 10.

According to the configuration shown in FIG. 7, as in the case described with reference to FIG. 6, the ink supplied from the ink tank 6 to the connecting ink introducing member 10 through the ink introducing slender tube 4 is drawn out by the capillary force of the plastic pen point 12, and put onto the writing paper from the tip end face of the plastic pen point 12.

In this process, if excess ink is supplied from the ink introducing slender tube 4 to the connecting ink introducing member 10, the excess ink is caused to flow into the stuffing member 7 and to accumulate therein. After that, the ink is caused to flow to the ink tank 6 through the plastic pen point 12 or the ink introducing slender tube 4 as necessary, whereby ink can always be supplied steadily to the plastic pen point 12.

(5) Other Embodiments

Although the case where the present invention is applied to the writing pen has been described in the above embodiments, the pen to which the present invention is applicable is not limited to the writing pen. In effect, the present invention can be applied to pens of various configurations such that the ink in the ink tank 6 can be supplied to the pen point 5 through the ink introducing slender tube 4.

Also, although the case where the spare ink tank 6 can be replaced with new one in the pen body 2 has been described in the above embodiments, the ink tank 6 is not limited to this. Even if an ink tank of a configuration requiring no replacement is used, the same effect as that of the aforementioned case can be achieved.

Also, although the case where the connecting portion is formed by sticking the projecting face 4F of the ink introducing slender tube 4 in the rear end portion of the pen point 5 has been described in the above embodiments, the way of forming the connecting portion is not limited to this. Even if a method is used in which the concave face 5F is formed in advance and the projecting face 4F is fitted into this formed concave face 5F, the same effect as that of the aforementioned case can be achieved.

Figure 8:
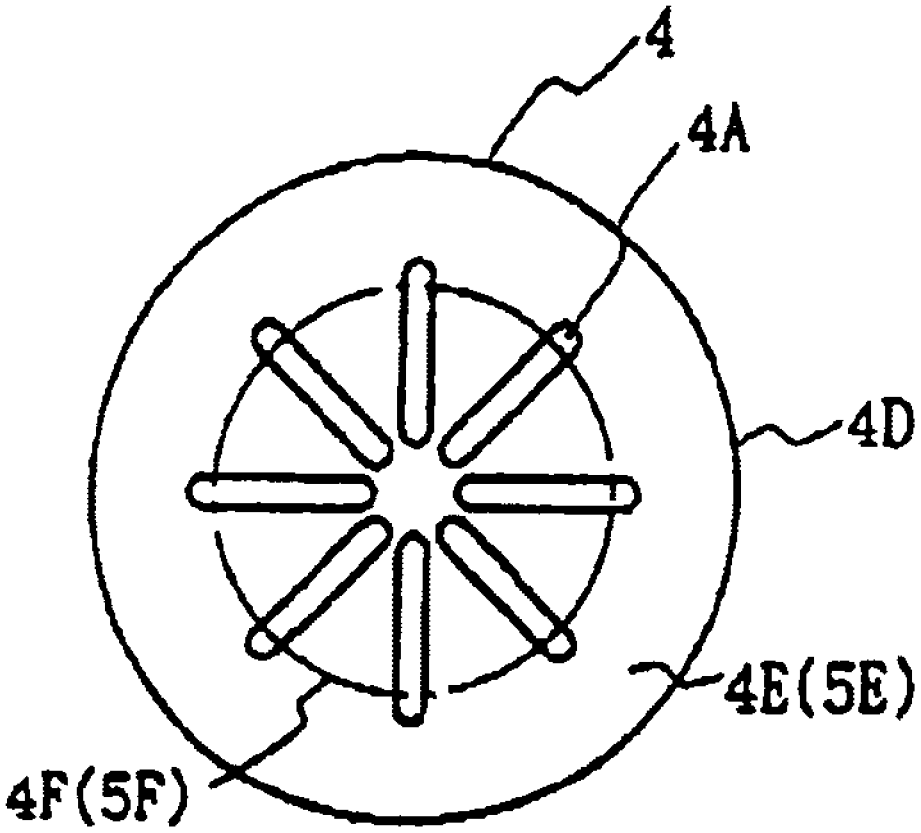
FIG. 8 is a cross-sectional view showing another embodiment of the ink introducing slender tube.

Also, even if, instead of the configuration in which the plurality of radial ink introducing Slits 4A are connected to each other at the center as the ink introducing slits 4A of the ink introducing slender tube 4 as described with reference to FIG. 2, the ink introducing slits 4A are separated so that they are not connected to each other at the center as shown in FIG. 8, the same effect as that of the case of FIG. 2 can be achieved.

As described above, according to the present invention, the ink in the ink tank is supplied to the pen point through the ink introducing slender tube, and also the stuffing member is provided so as to be in contact with the portion in which the ink introducing slender tube and the pen point are connected to each other, or the gap communicating with the stuffing member is provided in addition to the stuffing member. Thereby, the control of air necessary when ink is supplied to the pen point can be carried out properly, so that ink can be supplied to the pen point in proper amounts.

What is claimed is:

1. A pen comprising:

an ink tank for supplying ink;

an ink introducing slender tube having:

an open slender tube portion to induce capillary flow of ink formed inside said slender tube; and a rear end portion which is connected to said ink tank for introducing ink in said ink tank through said slender tube portion;

a pen point having:

a tip end face;

a back end portion; and pores for drawing ink out of said ink introducing slender tube to said tip end face thereof by connecting said back end portion thereof to tip end portion of said ink introducing slender tube; and a stuffing member, which is positioned in contact with said back end portion of said pen point, said stuffing member holding excess ink when excess ink flows out of said ink introducing slender tube and for supplying ink held in said stuffing member to said pen point when ink flowing to said pen point runs short.

2. The pen as defined in claim 1 further including:

a compression member positioned about said stuffing member so that said stuffing member is compressed to have a larger capillary force than at other portions thereof adjacent where said ink introducing slender tube and said pen point are connected to each other.

3. A pen comprising:

an ink tank for supplying ink;

an ink introducing slender tube having:

a slender tube portion formed inside said slender tube;

a rear end portion of which is connected to said ink tank for introducing ink from said ink tank through said slender tube portion a pen point having:

a tip end face;

a back end portion; and pores for drawing out ink flowing out of said ink introducing slender tube to said tip end face by connecting said back end portion thereof to said tip end portion of said ink introducing slender tube;

a fluid transfer gap, which is formed adjacent said ink introducing slender tube and said pen point where they are connected to each other, for opening a part of said slender tube portion of said ink introducing slender tube; and a stuffing member, which is provided in contact with said ink introducing slender tube and said pen point back end portion and said fluid transfer gap, for storing any excess ink flowing out of said gap or said back end portion of said pen point when excess ink is supplied from said ink introducing slender tube, and for supplying the ink stored therein to said pen point when the ink flowing to said pen point is insufficient.

4. The pen as defined in claim 3 further including:

a compression member positioned about said stuffing member so that said stuffing member is compressed to have a larger capillary force than at other portions thereof adjacent where said ink introducing slender tube and said pen point are connected to each.

5. A pen comprising:

a tank for supplying fluid;

a capillary tube having:

a rear end portion of which is connected to said tank for introducing fluid from said tank into said capillary tube; and a front portion;

a pen point having:

a tip end portion used to deliver fluid; and a back end portion positioned in fluid transfer relationship to said front portion of said capillary tube, said pen point delivering fluid from said back end portion to said tip end portion;

a fluid transfer interface formed adjacent said back end of said pen point and said front portion of said capillary tube; and a stuffing member, which is provided at said fluid transfer interface, for storing any excess fluid flowing out of said interface, and for supplying fluid stored therein to said pen point when the fluid flowing to said pen point is otherwise insufficient.

6. The pen as defined in claim 5 wherein said stuffing member is a porous member, said pen further including:

a compression member positioned adjacent said stuffing member so that said stuffing member is compressed to have an increased capillary force at said fluid transfer interface.

7. The pen as defined in claim 5 wherein said stuffing member is a porous member, said pen further including:

a compression member positioned radially about said stuffing member so that said stuffing member is compressed toward said fluid transfer interface to have an increased capillary force thereat.

8. The pen as defined in claim 5 wherein said pen point further includes:

a fluid transfer ball at said tip end thereof.

9. The pen as defined in claim 8 wherein said pen point further includes:

a pen point introducing member adjacent said fluid transfer ball; and a connecting fluid introducing member between said pen point introducing member and said capillary tube.

10. The pen as defined in claim 5 wherein said stuffing member extends substantially further behind said fluid transfer interface along said capillary tube than forward along said pen point.

11. The pen as defined in claim 5 wherein said capillary tube includes:

an interior cross-sectional structure including:

a plurality of lobes radially extending from a central passageway.

12. The pen as defined in claim 11 wherein said fluid transfer interface includes:

a fluid transfer gap so that at least a portion of said lobes are in contact with said stuffing member.

13. The pen as defined in claim 12 wherein said front portion of said capillary tube includes:

a spike structure, and wherein said back end portion of said pen point includes:

a receiving cone in which said spike is nested to allow fluid flow there between.

14. The pen as defined in claim 5 wherein said stuffing member is a porous member, said pen further including:

a compression member including:

a flexible fluid impervious membrane about said stuffing member: and a plurality of ribs positioned opposite said stuffing member adjacent said flexible fluid impervious membrane so that said stuffing member is compressed to have an increased capillary force at said fluid transfer interface.

15. The pen as defined in claim 14 wherein said ribs are wedge shaped with rear facing apexes, whereby said stuffing member can be moved forward during assembly to establish compression thereof.

16. The pen as defined in claim 5 wherein said pen point further includes:

a plastic pen point at said tip end portion; and a connecting fluid introducing member between said plastic pen point and said capillary tube.

17. The pen as defined in claim 5 wherein said capillary tube includes:

an interior cross-sectional structure including:

a plurality of unconnected slits extending radially outwardly.

18. The pen as defined in claim 5 wherein said pen point further includes:

a pen point introducing member adjacent said fluid transfer ball having a capillary action; and a connecting fluid introducing member between said pen point introducing member and said capillary tube having a capillary action, wherein said capillary action of said pen point is higher than said capillary action of said connecting fluid member.

19. The pen as defined in claim 5 wherein said tank is replaceable and when new is filled with marking fluid.

20. The pen as defined in claim 5 wherein said fluid is ink.

* * * * *